US005649379A

United States Patent [19]

Hoffman et al.

[11] Patent Number: 5,649,379

[45] Date of Patent: Jul. 22, 1997

[54] SUSPENDED MULTI-SIDED MESSAGE DISPLAY SIGNS

[75] Inventors: Michael S. Hoffman, Marblehead; Alan Stenfors, Scituate, both of Mass.

[73] Assignee: Rose Displays, Marblehead, Mass.

[21] Appl. No.: 501,170

[22] Filed: Jul. 11, 1995

[51] Int. Cl.[6] ..... G09F 7/22

[52] U.S. Cl. ..... 40/617; 40/575

[58] Field of Search ..... 40/575, 592, 606, 40/611, 617, 720, 729

[56] References Cited

U.S. PATENT DOCUMENTS

| | | | |
|---|---|---|---|
| 571,656 | 11/1896 | Golding . | |
| 1,740,845 | 12/1929 | Tilbe . | |
| 2,523,815 | 9/1950 | Cloyd . | |
| 3,449,848 | 6/1969 | Howell . | |
| 3,771,246 | 11/1973 | Ebner | 40/720 |
| 3,952,437 | 4/1976 | Mitchell | 40/720 |
| 4,001,959 | 1/1977 | Grendahl | 40/720 |
| 4,608,773 | 9/1986 | White | 40/606 |
| 4,870,769 | 10/1989 | Ogilvie . | |
| 5,046,274 | 9/1991 | David . | |
| 5,054,219 | 10/1991 | Hoyt et al. . | |
| 5,189,820 | 3/1993 | Komamura . | |

FOREIGN PATENT DOCUMENTS

| | | | |
|---|---|---|---|
| 656616 | 5/1929 | France | 40/575 |
| 411963 | 6/1934 | United Kingdom | 40/575 |

*Primary Examiner*—Brian K. Green
*Attorney, Agent, or Firm*—Dowell & Dowell

[57] ABSTRACT

Lightweight snap-together multi-sided hanging display signs which include upper and lower frames, each including at least three panel clamps which are interconnected at their ends with interlocking bracket and clip components in which the ends of pairs of vertical clamps are also seated.

7 Claims, 4 Drawing Sheets

Fig. 3
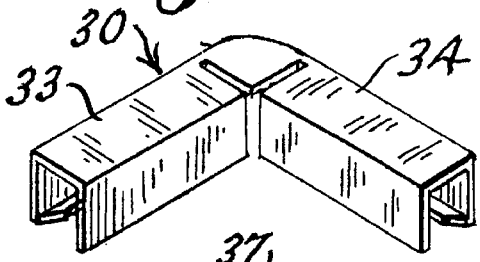
Fig. 4
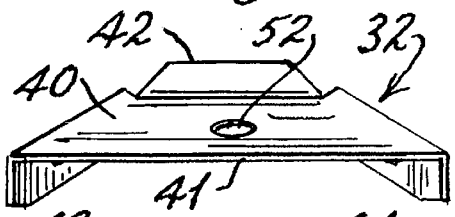
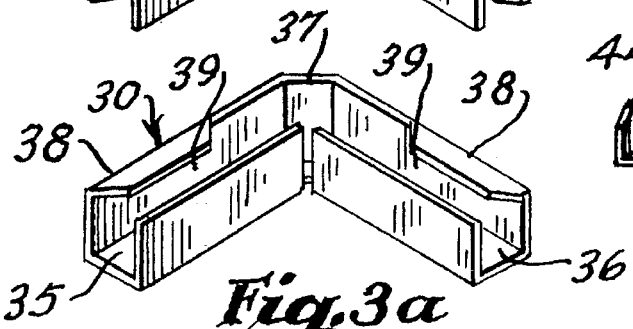
Fig. 3a
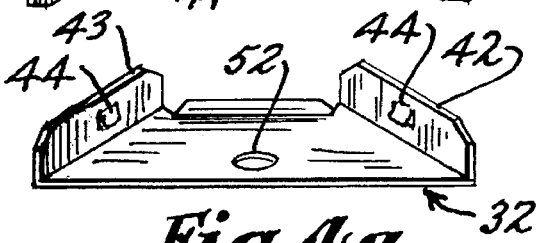
Fig. 4a
Fig. 5
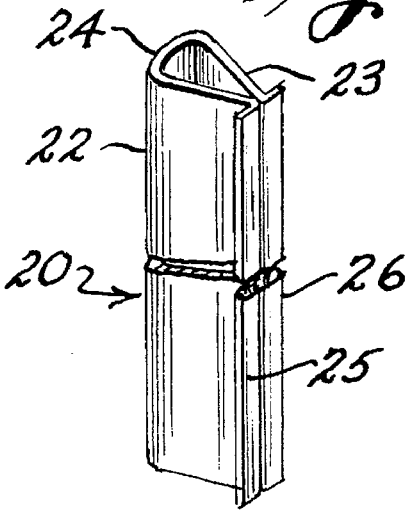
Fig. 6
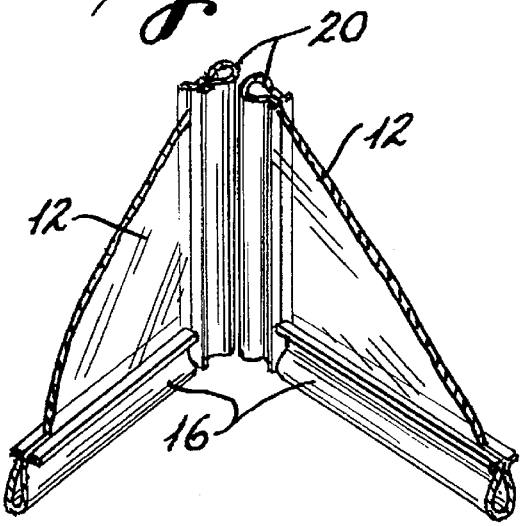
Fig. 7
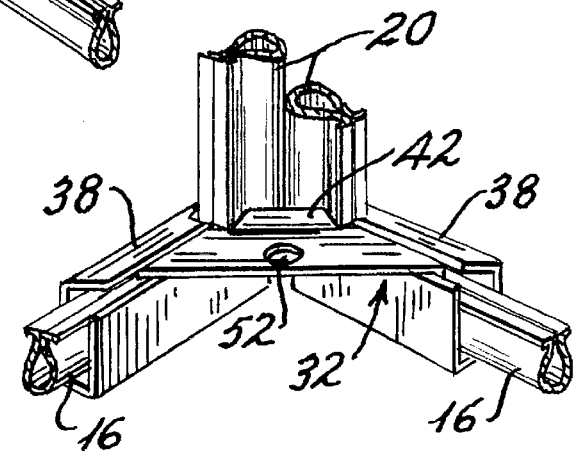

SUSPENDED MULTI-SIDED MESSAGE DISPLAY SIGNS

BACKGROUND OF THE INVENTION

1. Field of the Invention

This invention is generally directed to interior display signs of a type utilized to advertise various products in stores and, more particularly, to multi-sided lightweight hanging display signs which include upper and lower frame members which function as clamps for selectively retaining sign panels and which are united at their ends by interengaging clips and brackets of snap-together corner assemblies. The signs are designed to be suspended interiorly from the corner assemblies. In the preferred embodiment, the signs include interiorly disposed motors and light assemblies from which the signs are suspended so that the signs may be rotated at a pre-selected or variable speed.

2. History of the Related Art

Wide use is made in retail establishments of hanging posters or signs to advertise special products and sale items. In most instances, posters are simply printed on opposite sides of a posterboard or paper which may be secured to a wall or window area or which may be suspended from the ceiling utilizing hooks, wires or chains. Such conventional signs must be strategically positioned within a store so as to be readily viewable by customers. As such signs generally include advertising on only two sides which advertising is displayed in opposite directions, a limited field of visual display is created and often customers are not made aware of advertised items.

In addition to the foregoing, most conventional indoor suspended sign displays are static displays. That is, the displays are not designed for movement after they have been installed. Often, static displays do not attract the eyes of customers even if the display is properly oriented to be easily viewable.

In view of the foregoing, there is a long-standing need to provide signs which can have eye-catching geometric shapes and which permit a plurality of sign panels to be assembled in relationship such that the panels are viewable from numerous areas of a store. Further, there is a need to provide such signs which may be easily assembled or re-assembled into varying configurations depending upon the exact number of advertising or display panels which are desired for a given sign. Further, there remains a need to animate sign displays so as to attract the attention and interest of customers.

SUMMARY OF THE INVENTION

The present invention is directed to lightweight, snap-together multi-sided hanging display signs which may be assembled in a plurality of geometric shapes and which include components for mounting three or more separate advertising displays or panels thereto for purposes of increasing the effective field of the sign display and/or for allowing a plurality of separate items to be advertised or displayed on a single sign.

The invention includes upper and lower frames having at least three panel clamps which are connected at their ends by corner assemblies. Each corner assembly includes an interlocking bracket and clip. The bracket includes a pair of converging open channel portions in which ends of the poster or panel clamps of the upper and lower frames are slidingly received. Each bracket further includes a central open portion for receiving a pair of vertical panel clamp members which extend between the upper and lower frames. Each clip includes a pair of depending locking flanges which converge relative to one another from a central body portion and which flanges are receivable intermediate the end portions of the frame panel clamps and the converging open channel end portions of each bracket, thereby retaining the frame clamp members in interlocked relationship with respect to one another.

In the preferred embodiment, the clips include means for securing a hanging element such as a chain so that the signs are suspended from their interior. Each of the clamps associated with the upper and lower frames and extending vertically therebetween include opposing clamp surfaces for frictionally engaging a poster, picture or signboard (display panels) therebetween. In this manner, the advertising displays may be easily changed by simply removing the display panels from the frictional clamps and thereafter re-inserting a new panel. In some embodiments, a separate support panel members may be retained between the panel clamps to thereby define closed side walls for the display signs over which advertising or display panels may be selectively mounted by engagement with the opposing clamp members defining each of the upper and lower frames and the vertical clamps of the signs.

In a preferred embodiment, an electric motor is suspended within the interior of a display sign and the corner assemblies of the lower frame are suspended from the motor by chain elements which are connected to adjustable eye bolts the clip of each corner assembly so that the sign may be leveled as necessary by adjustment of the eye bolts.

In yet another embodiment, back lighting for the sign panels is provided by interior lighting which is mounted adjacent to the motor.

In yet a further embodiment, the revolving signs are stabilized utilizing an upper bearing element through which an electrical conduit extends and which supports the electric motor. The bearing is suspended from flexible elements such as chains from the corner assemblies of the upper frame of the sign.

It is a primary object of the present invention to provide lightweight snap-together multi-sided hanging display signs which may be assembled in a variety of geometric configurations so that display panels may be positioned in a plurality of orientations and whereby a plurality of different panels may be selectively displayed, if desired, from each side or face of the signs.

It is another object of the present invention to provide lightweight multi-sided hanging display signs which include horizontal and vertical sign panel engaging clamps which are joined at their ends to corner assemblies which include means for uniting a pair of horizontally extending clamps and a pair of vertically-extending clamps at each corner of the sign.

It is another object of the present invention to provide lightweight snap-together multi-sided hanging display signs which may be suspended from the interior thereof to thereby enhance their aesthetic appearance and which may be selectively rotated by interior motors at selected speeds so as to further increase customer awareness of the display panels which are mounted to the signs.

It is yet another object of the present invention to provide lightweight snap-together multi-sided hanging display signs which may be easily disassembled for compact storage and/or shipment and which may be easily assembled without the need for tools and thereafter suspended from substantially any type of ceiling, including a suspended ceiling.

BRIEF DESCRIPTION OF THE DRAWINGS

FIG. 3 is a perspective view of the outer portion of an corner bracket utilized with the present invention.

FIG. 3A is a perspective view of the inner portion of the corner bracket of FIG. 3.

FIG. 4 is a perspective view of the outer portion of interlocking clip of one of the corner assemblies of the present invention.

FIG. 4A is a perspective view of the inner portion of the clip of FIG. 4.

FIG. 5 is a perspective view of one of the display panel engaging clamps of the present invention.

FIG. 6 is a partial perspective assembly view illustrating a pair of vertical clamps at a corner of one of the display signs of the present invention showing the relationship of the vertical and horizontal panel engaging clamps prior to being interlocked by one of the corner assemblies of the present invention.

FIG. 7 is a view similar to FIG. 6 showing the vertical and horizontal clamps being assembled and locked in place between the interlocking bracket and clip components of a corner assembly of the present invention.

DESCRIPTION OF THE PREFERRED EMBODIMENT

Figure 1:
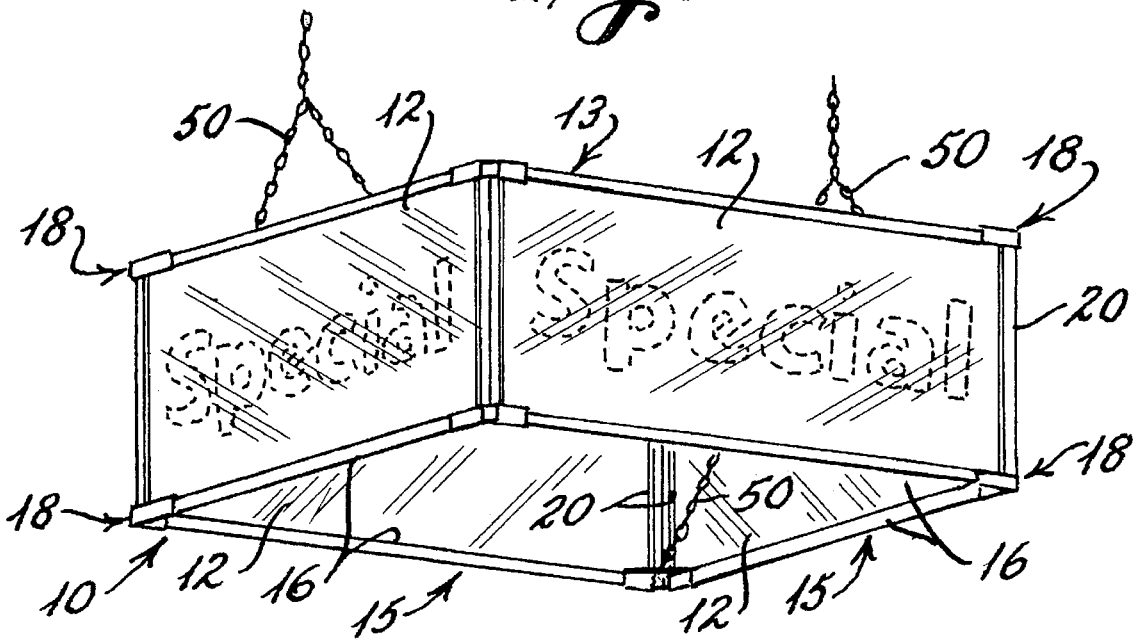
FIG. 1 is a perspective illustrational view of a first embodiment of the present invention showing a lightweight snap-together four-sided hanging display sign.
Figure 2:
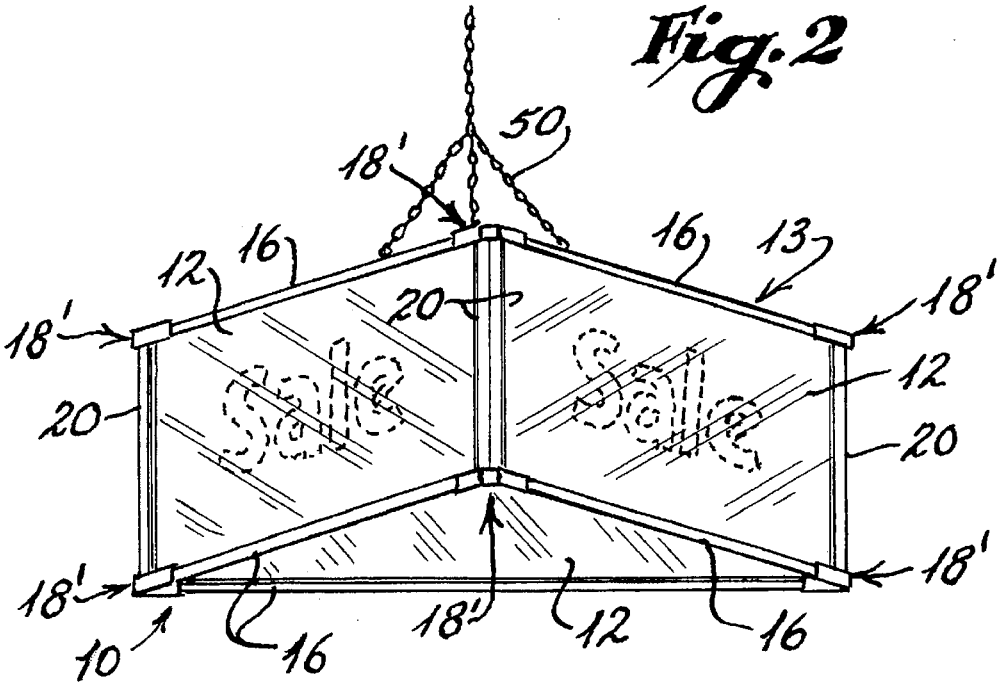
FIG. 2 is a perspective view of a second configuration of a lightweight snap-together three-sided hanging display sign utilizing similar frame and display components as the display sign of FIG. 1.

With particular reference to FIGS. 1 through 7, the primary components of the multi-sided hanging display signs 10 of the present invention are disclosed in detail. In FIG. 1, the frame components are shown as being assembled into a cubical configuration having four sign panels 12 associated therewith, whereas in FIG. 2, the sign configuration is triangular in cross section having three side panels 12 associated therewith. It should be noted that any geometric configuration having at least three sides may be constructed utilizing the components of the present invention. Therefore, the sign configurations shown in FIGS. 1 and 2 are for illustrational purposes only.

Each hanging display sign includes an upper frame 14 and a lower frame 15 each having a plurality of horizontally oriented elongated panel clamps 16 which are interconnected at their end portions by corner assemblies 18, as shown in FIG. 1, or corner assemblies 18', as shown in FIG. 2. Each of the upper and lower frames are vertically joined by pairs of vertically extending panel clamps 20 which are identical in cross-sectional configuration to the horizontal panel clamps 16.

With particular reference to FIGS. 5 through 7, each of the panel clamps 16 and 20 includes a pair of opposing elongated leg portions 22 and 23 which are integrally connected at a base 24. The leg portions 22 and 23 are yieldable relative to one another and are flared outwardly at their outer ends to form elongated flanges 25 and 26, respectively. The clamps are preferably formed of an extruded plastic material and are designed to provide a clamping force between the innermost edges of the flanges 25 and 26, as illustrated in FIG. 6.

The corner assemblies 18 and 18' each include a bracket member 30 and an interlocking clip 32. The brackets 30 include converging leg portions 33 and 34 which are generally U-shaped in cross section and which define open channels 35 and 36 which are of a size to slidingly and frictionally receive the end portions of the horizontally oriented panel clamps 16 as shown in FIG. 7. Each channel 35 and 36 converges toward an open central portion 37 in which the end portions of a pair of vertically extending panel clamps 20 are frictionally received, also as shown in FIG. 7. As shown in FIGS. 3A and 7, each of the leg portions 33 and 34 include inwardly extending flanges 38 which define slotted openings 39 into the channels 35 and 36. The flanges 38 assist in retaining the end portions of the horizontal panel clamps in the bracket. After the horizontal and vertical panel clamps are positioned within the channels 35 and 36 and the open space 37, of the corner assembly bracket member 30, the locking clip 32 is engaged, as shown in FIG. 7, with the bracket to thereby retain the panel clamps in an assembled relationship with respect to one another.

The locking clip 32 includes a body portion 40 which converges inwardly from an outer edge 41 towards an inner edge 42. As shown in FIG. 4, the inner edge 42 is formed as an upwardly extending tab for purposes of engaging the sides of the vertically extending panel clamps 20, as shown in FIG. 7. Each clip further includes a pair of converging outwardly extending flanges 42 and 43 having inwardly extending locking tabs 44 formed therewith. The flanges 42 and 43 are angularly oriented with respect to one another at the same angle as the leg portions 33 and 34 of the bracket 30. The angle of orientation between these components may vary depending upon the geometric configuration of the sign. Therefore, in the sign shown in FIG. 1, the leg portions 33 and 34 of the bracket 30 are oriented at approximately a 90° angle, as are the flanges 42 and 43 of the locking clip 32. In FIG. 2, however, the orientation of the legs 33 and 34 are 60° relative to one another with a similar angle being defined between the flanges 42 and 43 of the locking clips 32.

Each locking clip 32 is configured to extend diagonally between the leg portions 33 and 34 of a bracket 30 with the flange portions 42 and 43 being engagable within the openings 39 created into the channels 35 and 36 adjacent the flange portions 38 of the bracket. In this position, the locking tabs 44 will engage against one of the leg portions 22 or 23 of one of the horizontal panel clamps 16. The locking clips, however, will not obscure or cover any portion of the open area 37 in which the pair of vertical panel clamps are mounted.

With particular reference to FIGS. 1 and 2, the hanging display signs 10 of the present invention are preferably suspended from flexible elements 50, such as chains, which are mounted such as by hooks to openings 52 provided in the body portion of each of the clips 32. Also, the chains or other suspending elements are preferably connected to the clips associated with the corner assemblies 18 and 18' of the bottom frame 15 of each sign so that the weight of the upper frame and sign panels associated with each sign is directly carried by the lower frame thereby preventing the vertical panel clamps 20 from being disengaged from the brackets 30 at each of the corner assemblies 18 and 18'. In the embodiments shown in FIGS. 1 and 2, the sign panels 12 are clampingly engaged along the upper, lower and opposite side edges by oppositely oriented horizontal and vertical panel clamps. Sign panels may be easily disengaged from the clamps 16 and 20 without requiring the use of any tools to effect a change in panel display.

With the frame components of the present invention, the hanging display signs may be readily disassembled for storage or shipment in a very compact manner. Assembly and disassembly of the signs may be easily accomplished without the use of tools, thereby facilitating the use of the signs in commercial environments. In some embodiments, a separate support or backing panel, not shown in FIGS. 1 and 2, may be associated with each side of the sign in backing relationship to the panels 12 to provide further rigidity for the overall structure. Such backing panels would be retained by the horizontal and vertical panel clamps.

Figure 8:
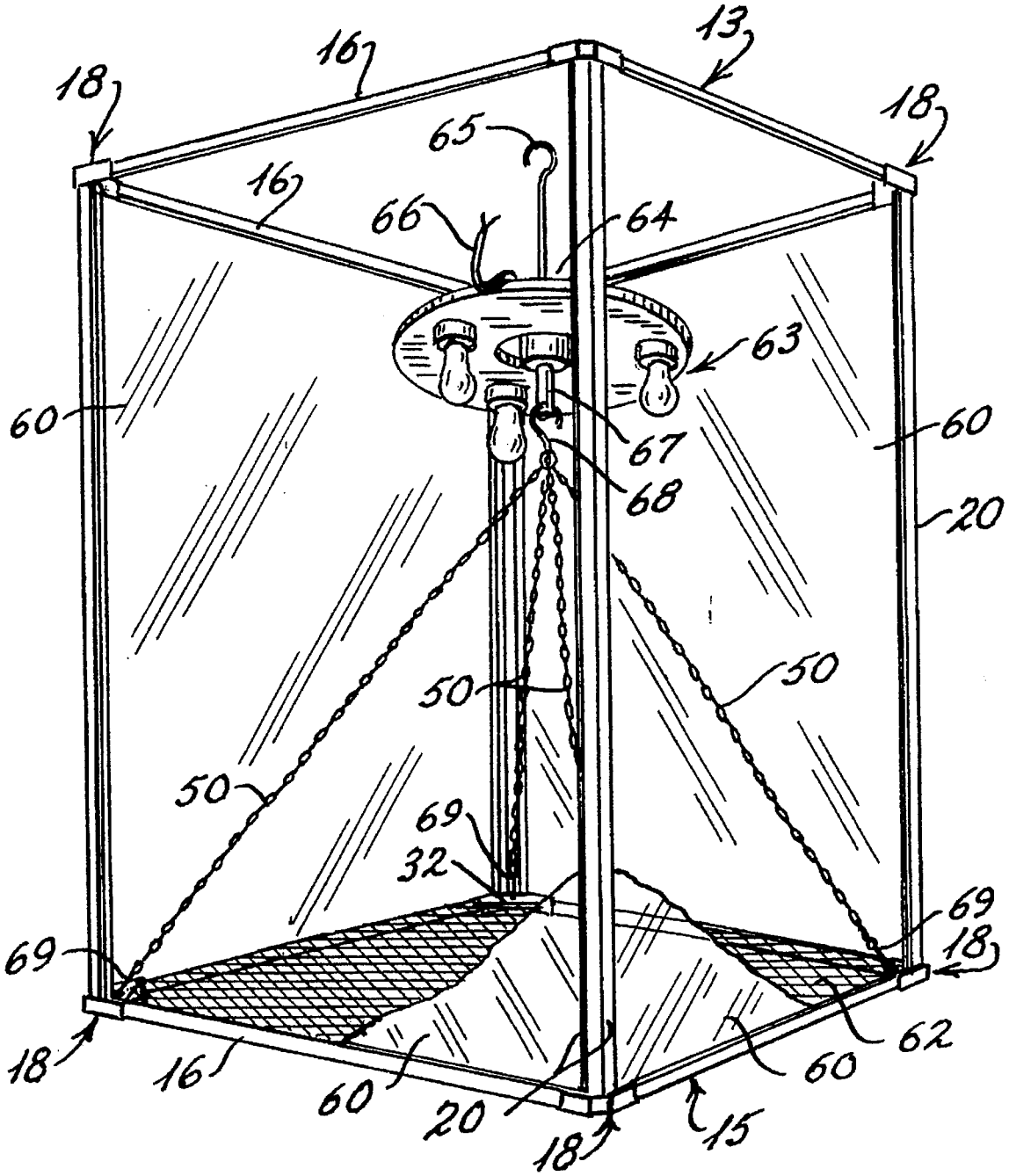
FIG. 8 is a perspective view, having portions broken away, showing an interior motor and lighting assembly for use with an embodiment of the present invention.
Figure 9:
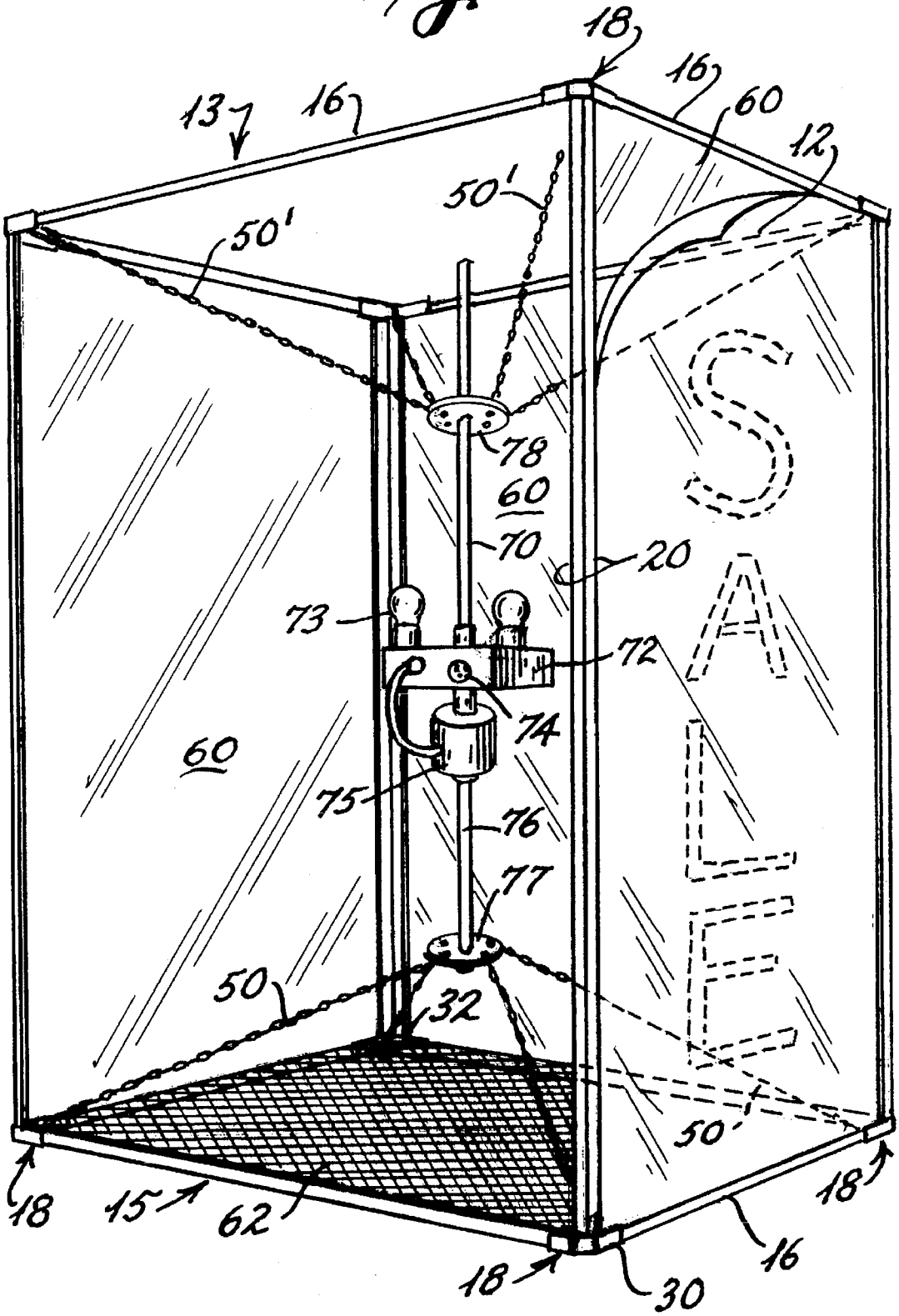
FIG. 9 is a perspective view, having portions broken away, of another embodiment of the present invention showing a variation of motor support structure for use in rotating the hanging display signs of the present invention.

In order to give the hanging display signs of the present invention greater utility, the signs may be further adapted to provide interior back lighting and may be placed into motion by incorporating motors as disclosed in the embodiments of FIGS. 8 and 9. In FIG. 8, the sign 10 is cubical in configuration having four sides in which translucent or transparent plastic backing panels 60 are mounted to the opposing pairs of horizontal and vertical panel clamps in a manner as previously described. Sign panels 12 carrying various indicia may be selectively mounted in covering relationship to the backing panels 60, also as previously described.

In this embodiment, the sign may incorporate a bottom panel or tray 62 which is simply seated against one of the elongated flanges 25 or 26 of each of the clamps 16 and 20 and which is generally opaque so as to block any light from being disseminated through the bottom of the sign. The sign is backlighted by an interiorly mounted lighting unit 63 which includes a plurality of bulbs which may vary in number and type depending upon the illumination required. The lighting fixture 63 is mounted to a motor 64 which is designed to be suspended by a hooked rod 65 from a ceiling or overhead component, not shown. Power to the motor is supplied through appropriate electrical conductors 66. The motor includes a downwardly extending rotary drive shaft 67 to which a suspension hook 68 is secured. A plurality of chain elements 50 extend from the hook 68 to adjustable eye bolts 69 which are threadingly engaged within the openings 52 of each of the clips 32 associated with each corner assembly 18 and 18'. By selectively adjusting the eyebolts 69, the level or pitch of the sign may be selectively adjusted.

In this embodiment, by activation of the motor 64, the sign 10 is placed into rotary motion as it is suspended on the drive shaft 67. The lighting fixture 65 provides appropriate back lighting for display signs 12 which are translucent or transparent in nature and which are mounted over the backing panels 60. In this embodiment, the display panels 12 may also be utilized without the backing panels 60.

In FIG. 9, a cubicle hanging display sign 10 is shown which is also adapted to be rotated and backlighted. In this embodiment, backing panels 60 as well as the display panels 12 are also shown. Likewise, a bottom tray 62 is provided for preventing light dissemination through the bottom portion of the sign. The sign is stabilized both with respect to the upper and lower frames 13 and 15, respectively. An electrical conduit 70 is provided through which appropriate electrical wires extend and which conduit is utilized to support the sign 10 from a ceiling structure or overhead fixture. An electrical housing 72 is mounted to the lower portion of the conduit 70 and provides a base for a plurality of lamps 73 and also provides for electrical outlets 74. A motor 75 is mounted to depend from the housing 72 and includes a conventional electrical cord which is engagable within one of the electrical outlets 74. The motor includes a drive shaft 76 which is provided with a mounting bracket 77 which is mounted to the lower end thereof. A plurality of chains 50 connect the bracket 77 with adjustable eyebolts 69 secured to each of the corner clips 32.

In the embodiment of FIG. 9, the upper frame 13 of the sign is also stabilized with respect to the light assembly and motor by an upper bearing 78 which has an opening centrally thereof through which the conduit 70 extends. The opening is of a sufficient size to allow rotation of the bearing 78 about the conduit 70. The bearing 78 includes a plurality of openings in which upper chains 50' extend to the openings in each of the clips 32 of the upper corner assemblies. The embodiment of FIG. 9 is particularly useful for larger hanging display signs where additional stability is required with respect to the upper portion of the sign during rotation of the sign by activation of the motor 75. The rate of rotation may be selectively adjusted by utilizing motors having a variable output.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A multi-sided hanging display sign on which a plurality of indicia bearing panels may be selectively retained, comprising, upper and lower frames, each of said frames having at least three corner assemblies and at least three horizontal panel engaging means each adapted to retain a panel, at least three vertically extending means for connecting opposing corner assemblies of said upper and lower frames in vertically spaced relationship relative to one another, each of said vertically extending means including a pair of vertical engaging means adapted to retain a panel, and first suspension means disposed interiorly of the sign and connected to said at least three corner assemblies of at least one of said upper and lower frames, each of said corner assemblies including a bracket and a clip, each bracket including converging leg portions which define open channels in which end portions of said horizontal panel engaging means are slidably received and an open central portion in which one of said vertically extending means for connecting said opposing corner assemblies of said upper and lower frames is received intermediate said end portions of said horizontal panel engaging means, each of said clips including a body portion and a pair of outwardly extending locking flanges which converge toward one another, and said locking flanges being receivable within said converging leg portions of said brackets for securing said end portions of said horizontal panel engaging means therein.

2. The multi-sided hanging display signal of claim 1 in which each of said locking flanges includes an outwardly extending locking tab formed therein, said locking tab being engagable with said end portions of said horizontal panel engaging means disposed within said brackets.

3. The multi-sided hanging display sign of claim 2 in which each of said vertical panel engaging means includes opposing resilient leg portions which are integrally connected at a base, and each of said horizontal panel engaging means including a pair of opposing elongated leg portions which are interconnected at a base.

4. The multi-sided hanging display sign of claim 3 including a plurality of backing panels mounted between opposing pairs of said upper and lower horizontal panel engaging means and opposing pairs of said vertically extending panel engaging means.

5. A multi-sided display sign comprising, a plurality of panels, upper and lower frames, each of said frames having at least three corner assemblies for uniting at least three horizontal panel clamps in angular end-to-end relationship with respect to one another, at least three pair of vertically extending panel clamps, each pair of vertically extending panel clamps being connected to vertically aligned and opposing corner assemblies of said upper and lower frames, each corner assembly including a bracket and a clip, each bracket including converging leg portions which define open channels in which end portions of said horizontal panel clamps are slidably received and an open central portion in which end portions of a pair of said vertical panel clamps are received intermediate said end portions of said horizontal panel clamps, each of said clips including a body portion and a pair of outwardly extending locking flanges which converge toward one another, said locking flanges being receivable within said converging leg portions of said brackets for securing said end portions of said horizontal panel clamps therein, and said plurality of panels being retained by opposing pairs of said at least three horizontal panel clamps and opposing pairs of said at least three vertically extending panel clamps.

6. The multi-sided hanging display sign of claim 5 including a plurality of backing panels mounted between said opposing pairs of said horizontal panel clamps and opposing pairs of said vertically extending panel clamps.

7. The multi-sided display sign of claim 5 including suspension means connected to said at least three corner assemblies of at least one of said upper and lower frames.

* * * * *